US005152738A

United States Patent [19]

Zehender

[11] Patent Number: 5,152,738

[45] Date of Patent: Oct. 6, 1992

[54] ADJUSTABLE FILM FOLDING TOOLING ASSEMBLY

[75] Inventor: David N. Zehender, Chesterfield County, Va.

[73] Assignee: Reynolds Metals Company, Richmond, Va.

[21] Appl. No.: 762,139

[22] Filed: Sep. 19, 1991

[51] Int. Cl.[5] ..... B65H 45/08; B65H 45/22

[52] U.S. Cl. ..... 493/440; 493/439

[58] Field of Search ..... 493/438, 439, 440

[56] References Cited

U.S. PATENT DOCUMENTS

| | | | |
|---|---|---|---|
| 228,162 | 6/1880 | Appel | 493/436 |
| 383,798 | 5/1888 | Crowell | 493/439 |
| 877,659 | 1/1908 | Maus | 493/439 |
| 1,046,193 | 12/1912 | Julyan | 493/439 |
| 1,501,499 | 7/1924 | Swift, Jr. | 493/440 |
| 1,613,505 | 1/1927 | Deligianes et al. | 493/406 |
| 2,023,734 | 12/1935 | Lamatsch | 493/439 |
| 2,190,823 | 2/1940 | Cloud | 270/93 |
| 2,490,930 | 12/1949 | Thompson | 93/82 |
| 2,540,844 | 2/1951 | Strauss | 270/93 |
| 2,619,057 | 11/1952 | Ellis | 493/439 |
| 3,059,549 | 10/1962 | Seiden | 493/440 |
| 3,066,932 | 12/1962 | Greiner | 493/440 |
| 4,304,561 | 12/1981 | Shingo | 493/439 |
| 4,591,354 | 5/1986 | Gelbard | 493/439 |
| 4,871,347 | 10/1989 | Brinkmeier | 493/439 |

*Primary Examiner*—William E. Terrell
*Attorney, Agent, or Firm*—Alan T. McDonald

[57] ABSTRACT

The adjustable film folding tooling assembly includes a frame assembly supporting a pair of shoe assemblies. The shoe assemblies are horizontally adjustable with respect to the frame assembly to accommodate varying widths of flexible film to be folded. Each shoe assembly includes an internal shoe and an external shoe. The internal shoes are configured in a defined geometry to provide two or three turning edges depending on whether single or double folding of flexible film material is desired. The pair of external shoes include features to permit angular adjustment with respect to a longitudinal axis of the tooling assembly as well as extension and retraction thereof to accommodate loose or baggy film material as well as positioning of the overlap of film after folding. The internal and external shoes of the adjustable film folding tooling assembly have a defined geometry which facilitates production and manufacture of the tooling assembly without costly empirical research or modeling. The internal and external shoes also include removably attachable inserts which are configured to minimize contact between flexible film material passing through the tooling assembly and various tool components.

18 Claims, 7 Drawing Sheets

ADJUSTABLE FILM FOLDING TOOLING ASSEMBLY

FIELD OF THE INVENTION

The present invention relates to an adjustable film folding tooling assembly for use in folding thin flexible material at high speeds into configurations such as a flattened tube. The adjustable film folding tooling assembly includes adjustable shoe assemblies which permit single or double folding of film material. The folding tool assembly also includes a defined geometry that produces consistent and reliable plastic film material handling while minimizing contact between the flexible film and tooling assembly components.

BACKGROUND ART

In the prior art, numerous apparatus have been proposed to fold flexible material in configurations such as tubes or the like. In these types of apparatus, a thin film such as a plastic sheet or web is continuously run in one direction through a folding apparatus to fold the plastic sheet or film in a particular configuration.

The following United States Patents disclose prior art apparatus used for folding thin flexible material:

U.S. Pat. No. 228,162 to Appel discloses a tube-machine for making pleated tubes for paper bags. The machine of Appel incorporates formers in combination with guides to form the pleated tubes. The design of Appel lacks any defined geometry with respect to the formers or guides.

U.S. Pat. No. 1,501,499 to Swift, Jr. discloses a web folding machine utilizing a plurality of folding bars to produce the desired configuration of the folded web. The initial folding bars do not support the flexible material when the design is set to fold wider material. In addition, the folding bars must be individually adjusted to change the fold spacing.

U.S. Pat. No. 1,613,505 to Deligianes et al. discloses a paper folding device including three triangularly shaped single folders that require four turning edges to make a single fold. In order to make two folds, the single folding operation would be repeated requiring a total of eight turning edges.

U.S. Pat. No. 2,190,823 to Cloud discloses a method and apparatus for folding strips of paper or the like. The apparatus includes a plurality of adjustable plates or strips that are removable for cleaning.

U.S. Pat. No. 2,490,930 to Thompson discloses an apparatus for forming tubes from sheet material. The material is guided over rods that are individually adjusted. The geometry of the rods produces a flattened tube with a seam aligned in the center of the tube. The apparatus of Thompson does not include features to adjust the width of the apparatus as well as means to position the seam off-center of the flattened tube axis.

U.S. Pat. No. 2,540,844 to Strauss discloses a web folding machine which includes adjustable width folding means. However, the amount of material folded per side is limited to less than half of the distance between folds. This machine is designed for folding over the edges of material rather than producing flattened tubes.

U.S. Pat. No. 4,304,561 to Shingo discloses a film folding device which produces a single fold. In order to produce a double fold, an additional set of tooling is required.

In view of the prior art discussed above, a need has developed to provide an improved plastic film folding tool which is adaptable to produce single or double folds. In addition, a need has developed to provide folding tooling which minimizes contact area between the plastic film and tooling components to reduce damage to the film as well as increase yield.

In response to this need, the present invention provides an improved adjustable plastic film folding tool assembly which includes features to fold plastic film in varied widths as well as having the ability to shift the film overlap from the center towards one edge. None of the prior art cited above teaches or fairly suggests an adjustable plastic film tooling assembly including all of the features of the present invention.

SUMMARY OF THE INVENTION

It is accordingly a first object of the present invention to provide an adjustable folding tool assembly which is designed to single or double fold thin flexible material at high speeds and without damaging the material.

It is a further object of the present invention to provide an adjustable film folding tooling assembly which includes the combination of internal and external shoes which provide reduced material-tool contact using a defined tool geometry to minimize scratching and eliminate frictional heating of the film.

It is a still further object of the present invention to provide an adjustable film folding tooling assembly which includes width adjusting means to permit production of folded plastic film in different widths.

It is a yet further object of the present invention to provide an adjustable film folding tooling assembly which includes adjustable external shoes which permit offsetting the overlap of the plastic film from the center towards an edge as well as compensation for flexible material having loose or baggy portions.

In satisfaction of the foregoing objects and advantages, there is provided an adjustable film folding tooling assembly which includes a frame assembly that supports right and left opposed shoe assemblies. Each shoe assembly includes an internal shoes and external shoe. The pair of internal shoes and external shoes coact to contact a continuously fed flexible film such as plastic to produce either a single folded sheet or a double folded sheet or flattened tube.

Each shoe assembly includes a shoe supporting assembly that is horizontally adjustable with respect to the frame assembly using adjusting means. The horizontally adjustable shoe assemblies permit the adjustable film folding tooling assembly to adapt to different widths of film to be folded. The shoe supporting assemblies also include means to permit angular adjustment of each external shoe to compensate for material lacking tension or having loose ends. The right external shoe supporting assembly also includes means to facilitate retraction or extension of the right external shoe to prevent contact between external shoes during width adjustment Each of the internal and external shoes may also include removably attachable side inserts, each side insert acting as a turning or folding edge during plastic film folding operations. Each of the inserts are configured in such a manner as to reduce contact between film to be folded and tool components. The internal and external shoes are also configured in a defined geometry which further reduces surface contact between film and tooling as well as permits tooling to be designed without costly and time-consuming empirical research and model construction.

In a further embodiment, the adjustable film folding tooling assembly may include a frame assembly which supports one shoe assembly. In this manner, the single shoe assembly may be used to perform single folding operations of film material.

BRIEF DESCRIPTION OF DRAWINGS

Reference is now made to the drawings accompanying the application, wherein.

DESCRIPTION OF THE PREFERRED EMBODIMENTS

The adjustable film folding tooling assembly is designed to single or double fold any thin flexible material at high speeds without damaging the material. In prior art folding apparatus such as double folders or flattened tube makers, undefined geometry in tool design causes damage to the material being folded as well as producing inconsistent quality. Other type folders such as single folders or center folders require four turning edges to make a single fold, which also contributes to increased contact between material to be folded and tool components and damage to material. Prior art tooling also lacks adjustability with respect to folding flexible films of varying width as well as film material that may have "baggy" edges or loose tension.

The adjustable film folding tooling assembly provides advantages over prior art folding tools, in one embodiment, by providing a defined geometry which defines the relationship between the various angles utilized in folding tooling assemblies. By defining the angles required to properly fold flexible material, the tooling may be designed without costly and time-consuming empirical research and model construction. The defined geometry also saves time and prototype costs in designing production tooling.

One result of the defined geometry is a reduction in contact between the film to be folded and the tool components. By using the defined geometry, the flexible material contacts the tool edges only. This edge contact minimizes the contact area between the tool and the flexible material which results in less friction and frictional heating as well as less scratching. The tool edges also provide continuous edges including an adjustable center edge which sets the width between double folds. This adjustable center edge provides continuous support for various widths, thereby permitting the flexible material to be run at higher speeds and greater tension.

The reduction in friction as a result of the reduced contact between film material and tool components also permits increasing the film tension during the folding operation. This increased tension also permits handling of film that was too loose or baggy for prior art apparatus.

The inventive adjustable film folding tooling assembly also includes adjustable features which permit accommodating film material of various widths. In addition, the inventive tooling assembly may shift the overlap produced in a single or double fold operation towards either edge, if desired.

Figure 1:
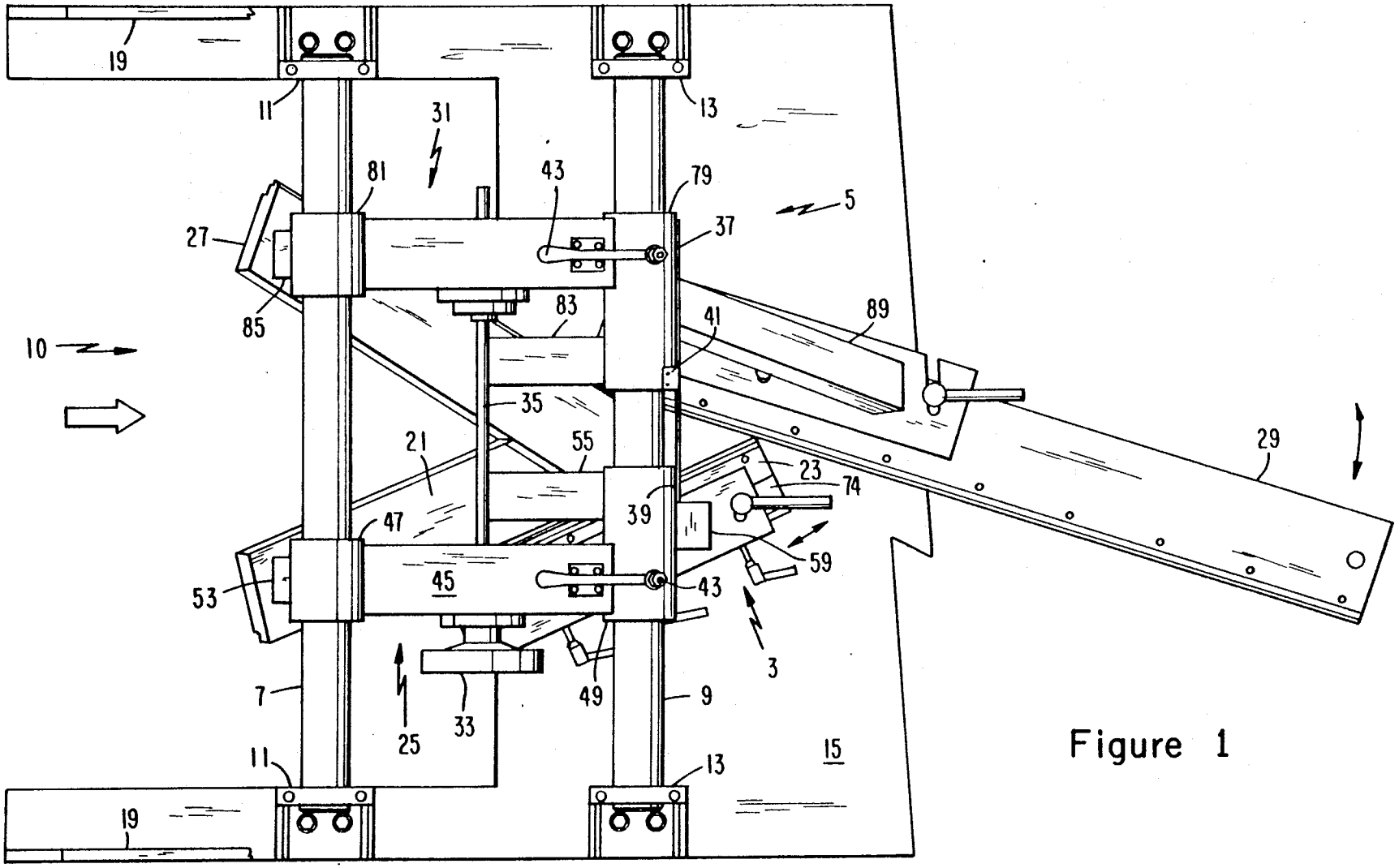
FIG. 1 shows a first embodiment of a plan view of an adjustable film folding tooling assembly.
Figure 2:
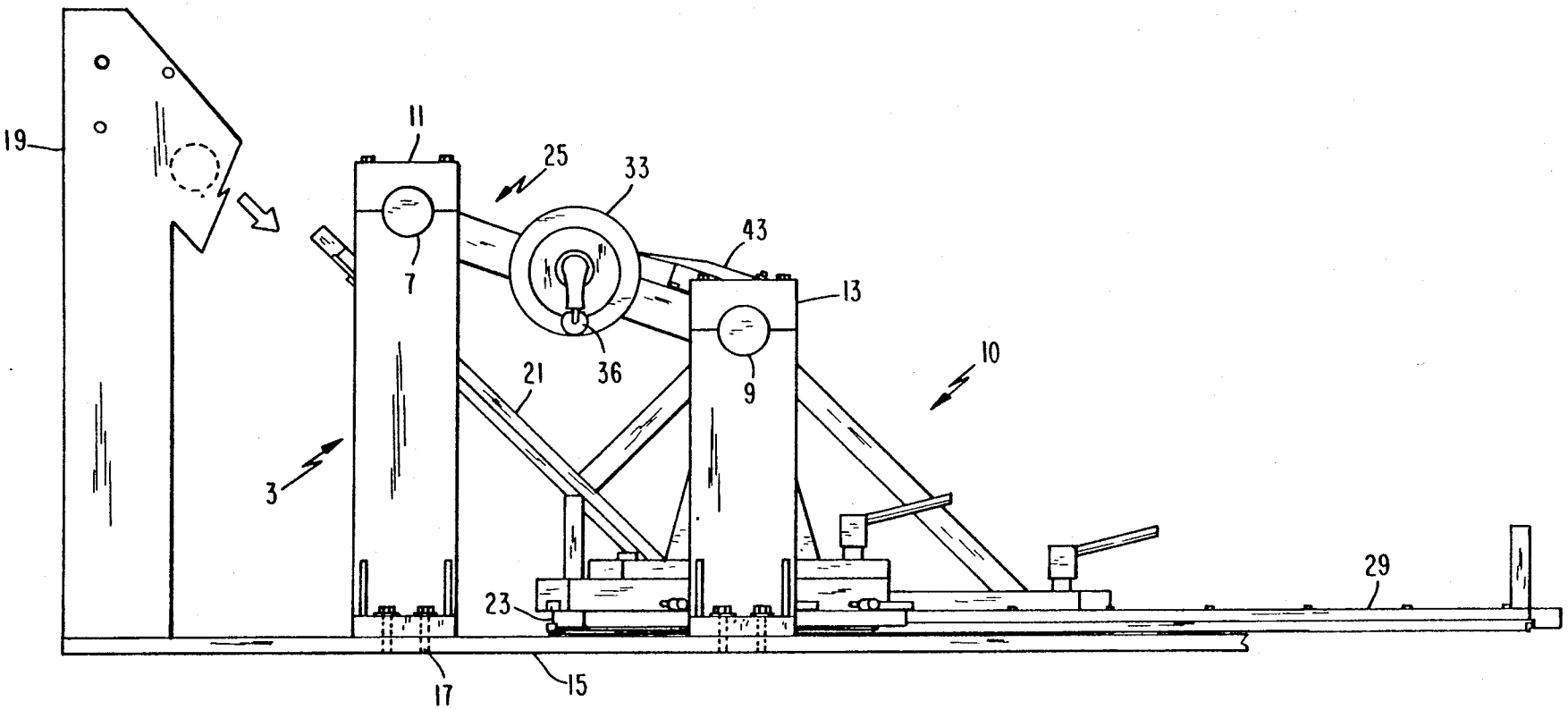
FIG. 2 shows a side view of the embodiment depicted in FIG. 1.

With reference now to FIGS. 1 and 2, the adjustable film folding tooling assembly is generally designated by the reference numeral 10 and is seen to include a frame assembly 1, a right shoe assembly 3 and a left shoe assembly 5. The block arrows in FIGS. 1 and 2 indicate the direction in which the plastic film travels when being subjected to a folding operation using the adjustable film folding tooling assembly. It should be understood that the tooling components are designated as left or right based upon viewing the tooling assembly from the entry end for feeding flexible film material to the tooling assembly.

The frame assembly 1 includes a pair of shafts 7 and 9, shaft 7 being supported by a pair of mounting brackets 11. The shaft 9 is supported by a pair of mounting brackets 13. Each of the mounting brackets 11 and 13 are designed to be attached to a seamer bed 15 which provides support for the tooling assembly during use. The brackets 11 and 13 may be attached to the seamer bed using bolts 17 or other fasteners. The seamer bed also includes a pair of side braces 19, which support a guide roll (not shown) for guiding the film material to be folded.

The right shoe assembly 3 includes a right internal shoe 21, a right external shoe 23, and a shoe supporting assembly 25. The left shoe assembly 5 includes a left internal shoe 27, a left external shoe 29, and a left shoe supporting assembly 31.

The right shoe assembly 3 and left shoe assembly 5 are designed to be horizontally adjustable by the width adjusting means 33 which is attached to the right shoe supporting assembly 25 and left shoe supporting assembly 31. The width adjusting means 33 includes a screw 35, rotation thereof by the handle 36 horizontally translates either or both of the shoe assemblies 3 and 5 by the shoe assemblies 25 and 31 riding along the shafts 7 and 9. By rotation of the screw 35, the relative width of the adjustable film folding tooling assembly may be changed depending on the width of the flexible film material to be fed therethrough. It should be understood that these types of adjusting devices are well recognized in the art, and are not considered an aspect of the present invention. Other known types of adjusting devices capable of horizontally translating either shoe assembly may be used.

In conjunction with the adjusting means 33, a scale 37 is provided which facilitates measurement of width changes or adjustments. The scale 37 is rigidly attached to the right shoe supporting assembly 25 at the reference numeral 39. The scale 37 is designed to be supported by bracket 41 and to slide through an opening (not shown) therein. The scale 37 should be rigidly affixed to only one of the shoe supporting assemblies to permit proper measurement of changes in tool width. The scale may include metric and/or standard dimensions. Alternatively, the scale may be rigidly attached to the left shoe supporting assembly 31 and slidably engaging a bracket on the opposed right shoe supporting assembly 25.

Each of the shoe supporting assemblies 25 and 31 include hold-down toggle clamps 43, which are well recognized in the prior art, to secure the shoe supporting assemblies 25 and 31 at a desired location along the shafts 7 and 9. Of course, other clamping means may be utilized such as set screws or the like to prevent translational movement of the shoe supporting assemblies during use of the tooling assembly.

Figure 3:
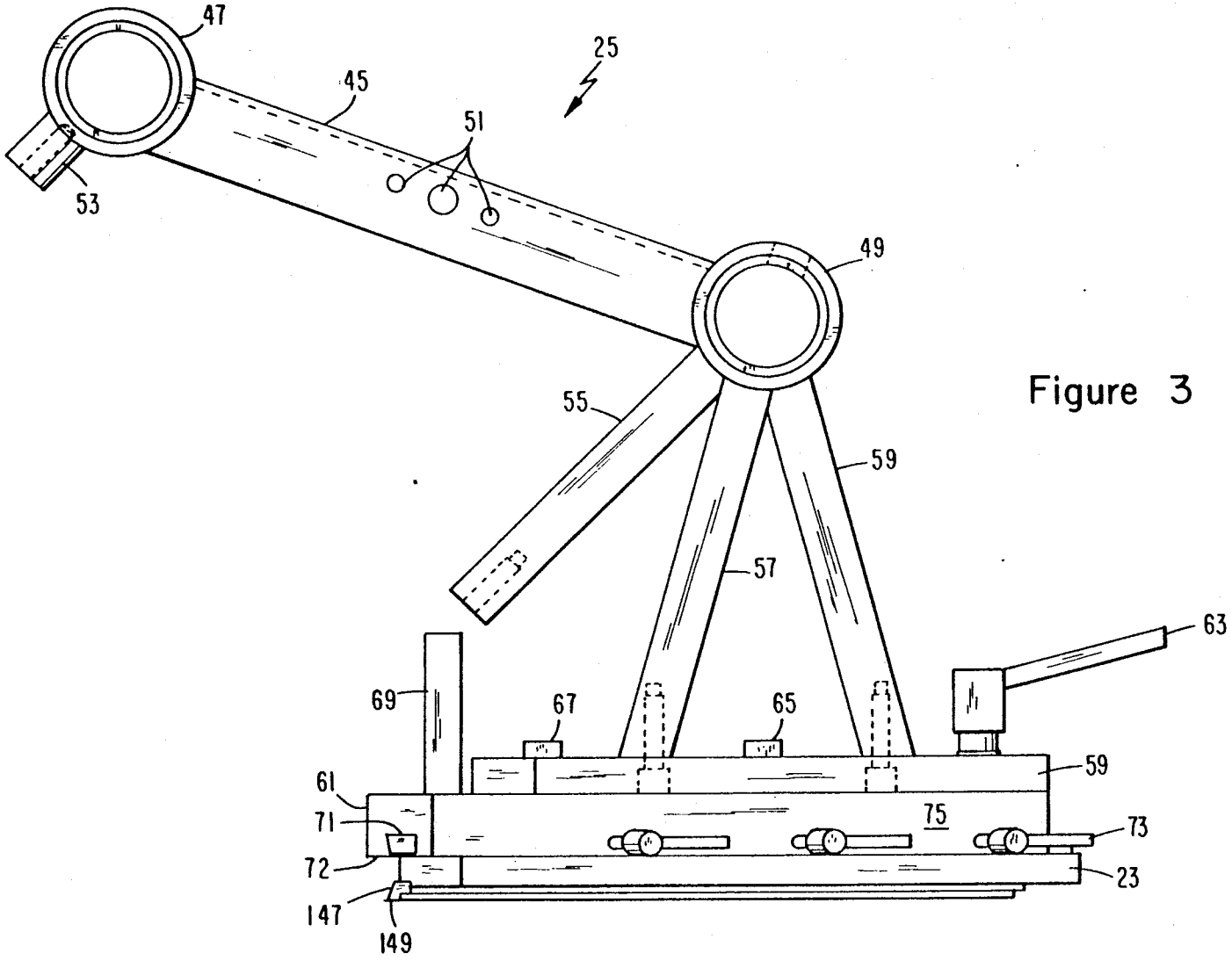
FIG. 3 shows a side view of the right external shoe and right shoe supporting assembly removed from the tooling assembly for clarity.

With reference now to FIGS. 1 and 3, the right shoe assembly is shown detached from the tooling assembly to show greater detail with regard to components thereof. The shoe supporting assembly 25 is seen to include a cross member 45 connecting the shaft collars 47 and 49. The cross member 45 also includes bores 51 therein to facilitate mounting the width adjusting means 33. The shaft collar 47 includes a support leg 53 with the shaft collar 49 including a support leg 55. The support legs 53 and 55 are designed to support the right internal shoe 21.

The shaft collar 49 also includes a pair of supporting legs 57 and 59, to support the right external shoe 23.

The right shoe supporting assembly also includes an angular adjusting plate 59 and a right shoe sliding plate 61.

As will be described in greater detail with respect to the left external shoe assembly, the angular adjusting plate 59 coacts with the shoe sliding plate 61 by the clamping bar 63 and through bolts 65 and 67. The angular adjusting plate 59 permits the sliding shoe plate 61 and right external shoe 23 to be angularly adjusted about a longitudinal axis of the tooling assembly.

The sliding shoe plate 61 includes a handle 69 extending upwardly therefrom which facilitates angular adjustment of the right external shoe. The sliding shoe plate 61 includes a dovetail-shaped slot 71 along a bottom surface 72 thereof. The dovetail-shaped slot 71 is designed to engage a complementary shaped protrusion extending along the upper face of the right external shoe 23. The sliding shoe plate 61 includes a plurality of clamping bars 73 along a side face 75 thereof. The clamping bars 73 include a threaded stud which threads through an opening in the sliding shoe plate 61 and engages a lateral surface of the protrusion 74 of the right external shoe 23. Rotation of the clamping bar 73 forces the threaded stud against the lateral surface of the protrusion 74 to secure the right external shoe in a desired position.

Figure 4:
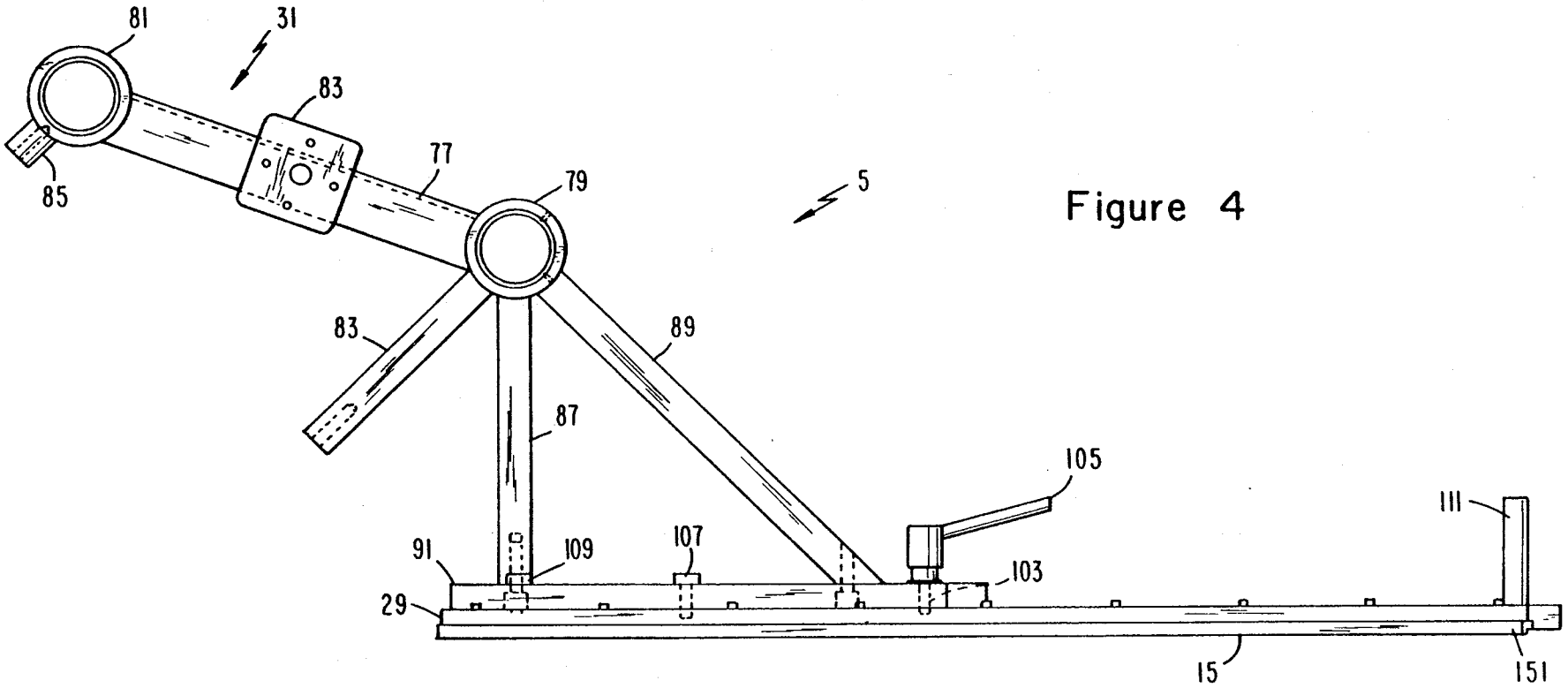
FIG. 4 shows a side view of the left external shoe and left shoe supporting assembly removed from the tooling assembly for clarity.

With reference now to FIGS. 1 and 4, the left shoe assembly is shown in FIG. 4 detached from the adjustable film folding tooling assembly for greater clarity. The left shoe supporting assembly 31 includes a cross member 77 which connects the shaft collars 79 and 81 together. The cross member 77 also includes a flange 83 which facilitates attachment of the width adjusting means 33. The shaft collars 79 and 81 include legs 83 and 85, respectively. The legs 83 and 85 support the left internal shoe 27.

The shaft collar 79 also includes legs 87 and 89 which support the left external shoe 29.

Figure 5:
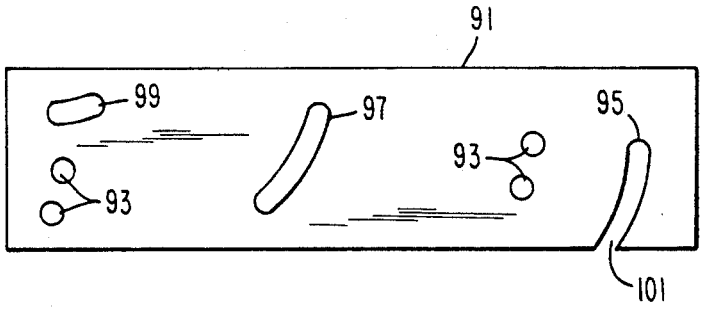
FIG. 5 shows a plan view of the angular adjustment plate for the left shoe assembly.

The left shoe supporting assembly 31 includes angular adjusting plate 91 attached to the legs 87 and 89. With reference now to FIG. 5, the angular adjusting plate 91 is in the form of a generally rectangular plate which includes openings 93 to facilitate attachment to the legs 87 and 89. The angular adjusting plate 91 includes a plurality of radial slots 95, 97 and 99. The radial slot 95 includes an opening 101 at an end thereof. Extending through the radial slot 95 in the angular adjusting plate 91 is a threaded stud 103 of the clamping means 105. In a similar manner, the studs 107 and 109 extend through the radial openings 97 and 99, respectively, to threadably engage complementary threaded openings (not shown) in the shoe 29. By this configuration, the left external shoe 29 may be adjusted angularly with respect to the stationary adjusting plate 91 by movement of the studs 103, 107 and 109 within the slots 95, 97 and 99, respectively. By permitting the external shoe 29 to be angularly adjusted with respect to a longitudinal axis of the tooling assembly, the external shoe 29 may be adjusted to accommodate film material having loose or baggy edges. The left external shoe 29 also includes a handle 111 which facilitates angular adjustment.

Once the external shoe is positioned in a particular configuration, the clamping means 105 is tightened to clamp the external shoe against the bottom surface of the angular adjusting plate 91 in a similar manner as that described for clamping means 73 for the right external shoe.

Figure 6:
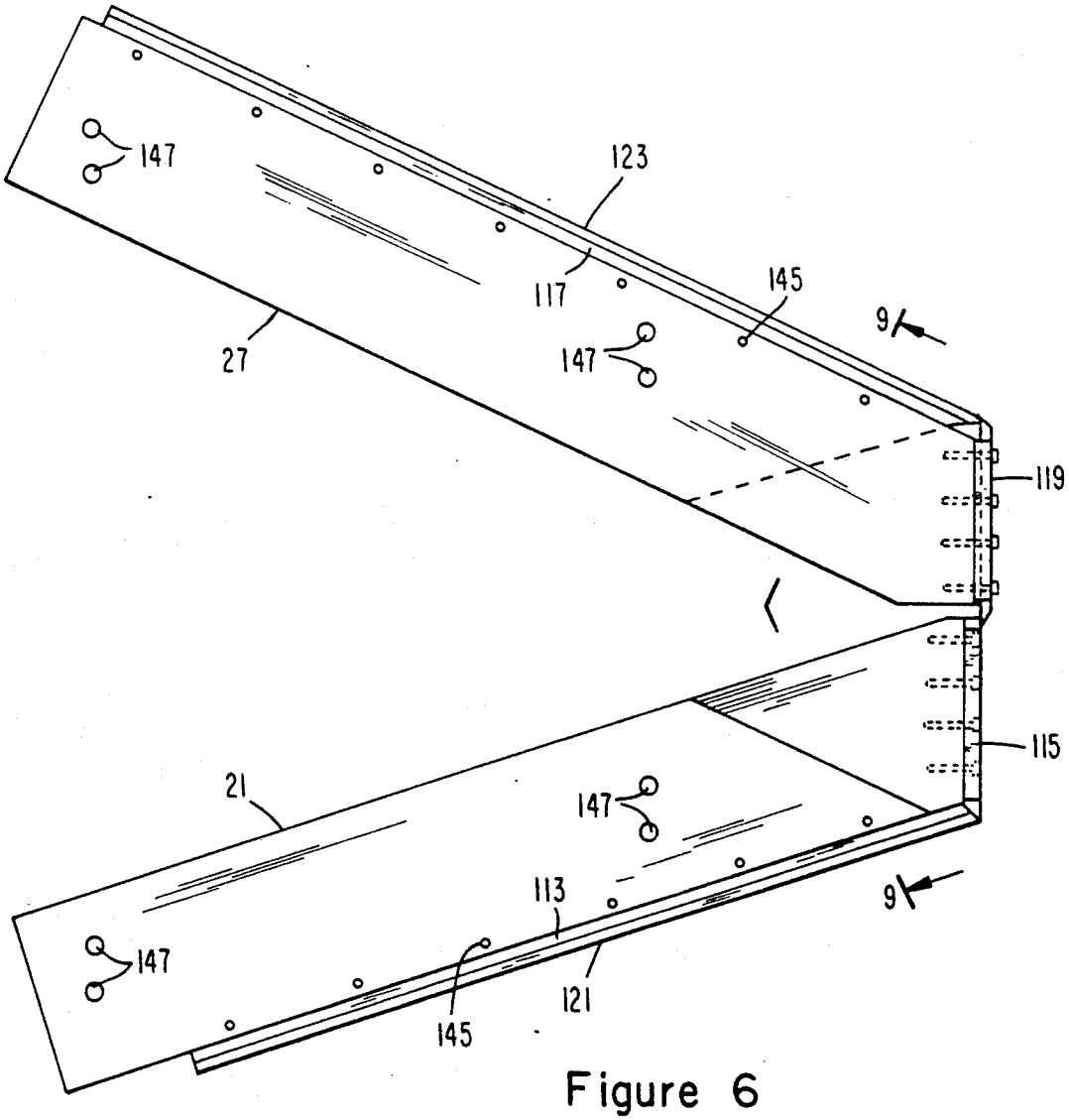
FIG. 6 shows an exploded plan view of the right and left internal shoes removed from the shoe assembly to show greater detail.

With reference now to FIGS. 6-9, a plan view of the internal right and left shoes, 21 and 27, respectively, is shown in FIG. 6. As can be seen from this drawing, the right and left shoes are shown exploded in contrast to the mating relationship depicted in FIG. 1. The right internal shoe 21 includes a side insert 113 and an end insert 115. The left internal shoe 27 includes a side insert 117 and an end insert 119. The side inserts 113 and 117 provide turning edges 121 and 123, respectively. As will be described hereinafter, the side inserts 113 and 117 are configured in such a manner so as to minimize material contact with other tool components.

Figure 7A:
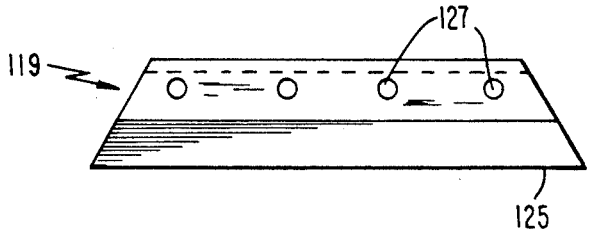
FIG. 7A shows a front view of the left internal shoe insert.
Figure 7B:
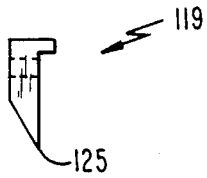
FIG. 7B shows a side view of the left shoe insert depicted in FIG. 7A.
Figure 8A:
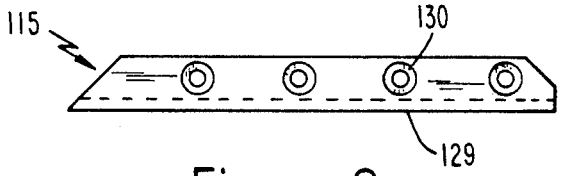
FIG. 8A shows a front view of the right internal shoe insert.
Figure 8B:
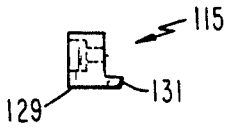
FIG. 8B shows a side view of the right shoe insert depicted in FIG. 8A.

With reference now to FIGS. 7 and 8, the end insert 115 of the right internal shoe 21 and the end insert 119 of the left internal shoe 27 are configured to produce a single turning edge which can accommodate various widths of flexible film material. As can be seen from FIGS. 7A and 7B, the left internal shoe end insert 119 includes a turning edge 125 and a plurality of through openings 127 which facilitate attachment to the front face of the left internal shoe 27. The turning edge 125 of the end insert extends below the bottom surface of the left internal shoe 27 to minimize contact between the film material to be folded and the internal shoe 27.

In a similar manner, the right internal shoe end insert 115 includes a lower edge 129 and a plurality of through openings 130 which facilitate attachment of the end insert 115 to the shoe 21. The end insert 115 includes a lip portion 131 which facilitate attachment of the end insert 115 to the shoe 21. The end insert 115 includes a lip portion 131 which is designed to engage the undersurface of the right internal shoe 21. The lip 131 provides separation between the material contacting the edge 129 and the undersurface of the shoe 21.

Figure 9:
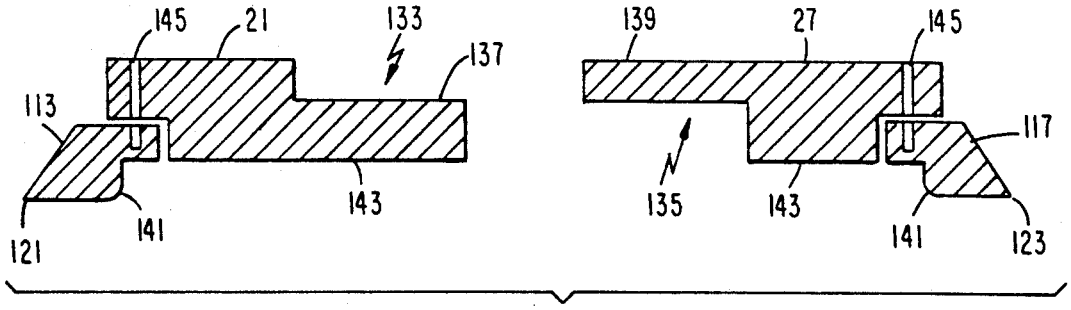
FIG. 9 shows a cross-sectional view taken along the line IX—IX depicted in FIG. 6.

With reference to FIG. 9, a cross-sectional view of the right and left internal shoes is depicted which more clearly illustrates the manner in which the right and left internal shoes engage during width adjustment. The right internal shoe 21 includes a recess 133, with the left internal shoe including a recess 135. During width adjustment, the reduced thickness section 137 of the shoe 21 may merge with the recess 135, with the reduced thickness section 139 of the shoe 27 merging with the recess 133 in the internal shoe 21. By this merging, the end inserts 115 and 119 overlap, as best seen in FIG. 6, to maintain a continuous turning edge along the front portion of the combination of internal right and left shoes.

With reference to FIG. 9 again, the configuration of the side inserts 113 and 117 is more clearly illustrated. Each side insert includes a protruding portion 141 which maintains a separation between flexible film material contacting the edges 121 and 123 from the bottom surfaces 143 of the internal shoes 21 and 27. The side inserts 113 and 117 are attached to the shoes 21 and 27, respectively, using a threaded bolt or the like through the openings 145. Each of the right and left internal shoes also include through openings 147, see FIG. 6, which facilitate attachment to the support legs of the shoe supporting assemblies.

It should be understood that the side inserts 113 and 117 depicted in FIGS. 6 and 9 are typical of the side inserts used on the right and left external shoes. With reference back to FIGS. 3 and 4, the right external shoe includes a side insert 148 with a turning edge 149 thereon with the left external shoe having a side insert 151 with a turning edge 153 thereon. The removable feature of the side inserts permits replacement thereof when the turning edges are damaged or worn. The removable side inserts also facilitate utilizing a coating thereon to reduce frictional contact between the turning edges and film material. The coating may be any known type of coating recognized to reduce frictional losses such as a Teflon-like material.

Figure 10A:
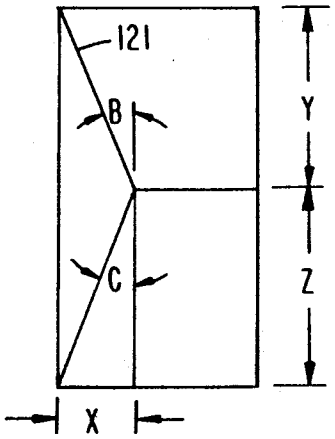
FIGS. 10A-10C depict schematic representations of defined geometry for producing a single fold using a flexible film.
Figure 10B:
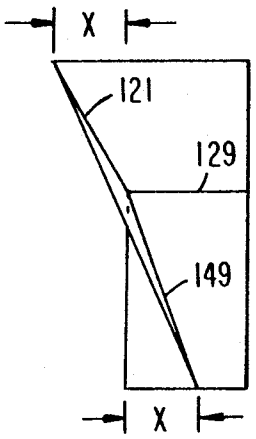
Figure 10C:
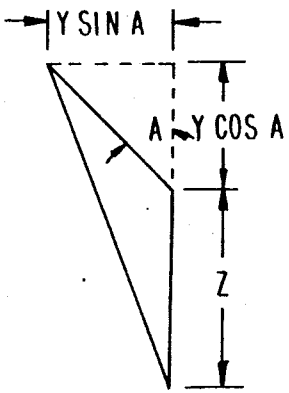

With reference now to FIGS. 10A–10C, a derivation of an equation defining the folding geometry that defines the adjustable film folding tooling assembly will be explained. FIG. 10A shows an unfolded strip of flexible film, FIG. 10B shows the film being folded to produce a single fold. FIG. 10C shows a side view of the folded material in FIG. 10B. In a single folding operation, and as best seen in FIG. 10B, the adjustable film folding tooling assembly produces a single fold using three turning edges. The three turning edges include edge 121 of the right internal shoe, edge 129 of the right internal shoe end insert, and edge 149 of the right external shoe. In operation, a flexible film is continuously run over a guide roll and through the tooling such that the film first passes beneath the internal shoes. The film, folded by the internal shoe turning edges, is further folded by the external shoe turning edges, thereby producing a flattened tube having an overlap therein. It should be understood that in this exemplary single fold illustration, only the right shoe assembly is utilized therefor.

Figure 11A:
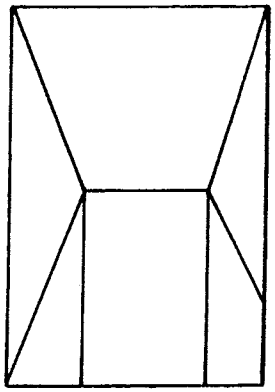
FIGS. 11A-11C depict a schematic representation of defined geometry for producing a double fold for flexible film.
Figure 11B:
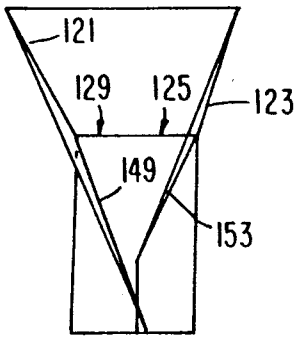
Figure 11C:
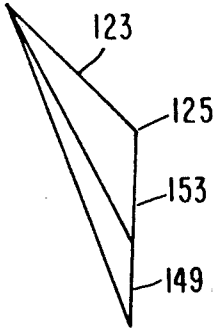

With reference to FIGS. 11A–11C, a double fold operation is illustrated. FIG. 11A shows the film material to be double folded in a flat configuration. FIG. 11B illustrates the five folding edges utilized in a double folding operation, and FIG. 11C depicts a side view of the folded film in FIG. 11B. As can be seen from FIG. 11B, producing a double fold film uses five turning edges. The turning edges include edge 121 of the right internal shoe, edge 123 of the left internal shoe, edges 125 and 129 of the internal shoe end inserts, 119 and 115, respectively, edge 149 of the right external shoe and edge 153 of the left external shoe.

It should be understood that by extending or retracting the right external shoe and edge 149 combined with angularly adjusting the left external shoe 29 and turning edge 153, the overlap in the flattened tube product may be shifted from the center toward the right edge. Center to left edge overlap shifting may be achieved by building the mirror image of the illustrated tooling.

With reference back to FIGS. 10A–10C, the different angles involved in producing a single fold as well as the dimensions of different portions of the film material to be folded are illustrated. As set forth hereinbelow, a strict definition of the relationship between the angles in the folding geometry has been developed. The derivation of the equation utilizating the variables depicted in FIGS. 10A–10C is as follows:

| | Derivation Step |
|---|---|
| 1 | $(y - z)^2 = 4x^2 - (y\mathrm{Cos}A - z)^2 - y^2\mathrm{Sin}^2A$<br>Explanation: Three-dimensional Pythagorean theorem |
| 2 | $y^2 - 2yz - z^2 = 4x^2 - y^2\mathrm{Cos}^2A - 2yz\mathrm{Cos}A - z^2 - y^2\mathrm{Sin}^2A$<br>Explanation: Algebraic expansion of step 1 |
| 3 | $y^2 - 2yz = 4x^2 - y^2(\mathrm{Cos}^2A - \mathrm{Sin}^2A) - 2yz\mathrm{Cos}A$<br>Explanation: Subtracted $z^2$ |
| 4 | $y^2 - 2yz = 4x^2 - y^2 - 2yz\mathrm{Cos}A$<br>Explanation: $\mathrm{Cos}^2A - \mathrm{Sin}^2A = 1$ |
| 5 | $2yz = 4x^2 - 2yz\mathrm{Cos}A$<br>Explanation: Subtracted $y^2$ |
| 6 | $\mathrm{Tan}B = x/y$ $\mathrm{Tan}C = x/z$<br>Explanation: Definition of tangent function |
| 7 | $y = x/\mathrm{Tan}B$ $z = x/\mathrm{Tan}\,B$<br>Explanation: Solved for y and z |
| 8 | $2x^2/(\mathrm{Tan}B \cdot \mathrm{Tan}C) = 4x^2 - 2x^2\mathrm{Cos}A\,(\mathrm{Tan}B \cdot \mathrm{Tan}C)$<br>Explanation: Substituted step 7 for y and z in step 5 |
| 9 | $1/(\mathrm{Tan}B \cdot \mathrm{Tan}C) = \mathrm{Cos}A/(\mathrm{Tan}B \cdot \mathrm{Tan}C) - 2$<br>Explanation: Divided by $2x^2$ |
| 10 | $1 = \mathrm{Cos}A - 2(\mathrm{Tan}B \cdot \mathrm{Tan}C)$<br>Explanation: Multiplied by $\mathrm{Tan}B \cdot \mathrm{Tan}C$ |

By defining the relationship between angles in the folding geometries, the tooling can be designed without costly and time-consuming empirical research and model construction. For example, the angle B corresponds to the angle of the right internal shoe and the angle C corresponds to the angle of the right external shoe, each angle being relative to the longitudinal axis of the tooling assembly. Angle A defines the inclination of the internal shoes with respect to the base or seamer bed of the folding tooling assembly.

It should be noted that although threaded clamping means are shown for securing angular adjustment of the right and left external shoes as well as retraction or extension of the external right shoe, other clamping means known in the art may be utilized in substitution therefor. In addition, other means such as a pivoting attachment between the angular adjusting plate and external shoes may be utilized to achieve the angular adjustment of the right and left external shoes.

In a further embodiment, the internal shoes may vary in width such that the turning edge resulting from the combination of the end inserts therefrom may also vary. In one embodiment, the internal shoes may be configured with a width half of that depicted in FIG. 6. The combination of more narrow internal shoes facilitates folding flexible film of narrow width. In addition, a single shoe assembly may be utilized for single fold application.

As such, an invention has been disclosed in terms of preferred embodiments thereof which fulfill each and every one of the aspects of the present invention as set forth hereinabove and provides a new and improved adjustable film folding tooling assembly for use in folding of flexible material.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An adjustable tooling apparatus for folding thin flexible material passing through said apparatus comprising:

(a) a frame;

(b) a first shoe assembly and a second shoe assembly, said first shoe assembly and said second shoe assembly being spaced apart and supported by said frame;

(c) means for adjusting the spacing between said first and second shoe assemblies to accommodate different folding techniques for said flexible material;

(d) each of said first and second shoe assemblies further comprising:

(i) an internal shoe and an external shoe, each internal shoe having a side edge in continuous contact with said flexible material which provides continuous support to said flexible material along a first turning edge for folding said flexible material, each said internal shoe having an end edge in continuous contact with said flexible material, said end edges being configured to cooperatively provide continuous support to said flexible material along a second turning edge for folding said flexible material and each said external shoe having a side edge in continuous contact with said flexible material which provides continuous support to said flexible material along a respective third turning edge for folding said flexible material;

(ii) means for angularly adjusting at least one of said external shoes with respect to a longitudinal axis of said adjustable tooling assembly;

(iii) means for retracting or extending at least one of said external shoes along a longitudinal axis of said external shoe;

(e) whereby said internal shoes and external shoes are aligned with respect to a longitudinal axis of said adjustably tooling assembly to fold said flexible material in a predetermined manner.

2. The apparatus of claim 1, further comprising measurement means for indicating said spacing between said first shoe assembly and said second shoe assembly.

3. The apparatus of claim 2, wherein said measurement means further comprises a scale slidably connected to said first shoe assembly and rigidly connected to said second shoe assembly.

4. The apparatus of claim 1, wherein said internal shoes are configured to permit overlap therebetween while providing said continuous support to said flexible material along said second turning edge.

5. The apparatus of claim 1, further comprising clamping means for clamping said first shoe assembly and said second shoe assembly in predetermined positions on said frame.

6. The apparatus of claim 1, wherein said means for angularly adjusting said at least one of said external shoes further comprises means to clamp said at least one of said external shoes in a predetermined angular position.

7. The apparatus of claim 1, wherein said means for retracting or extending said at least one of said external shoes further comprises clamping means to clamp said at least one of said external shoes in a predetermined position.

8. The apparatus of claim 1, wherein each said internal shoe further comprises:

(i) a removably attachable side insert, each said removably attachable side insert including a said side edge which provides continuous support to said flexible packaging material along a respective said first turning edge; and (ii) a removably attachable end insert, said end insert of said internal shoe of said first shoe assembly and said end insert of said internal shoe of said second shoe assembly being configured to cooperatively provide continuous support to said flexible material along said second turning edge.

9. The apparatus of claim 1, wherein each said external shoe further comprises a removably attachable side insert, each said side insert including said side edge which provides continuous support to said flexible material along a respective third turning edge.

10. The apparatus of claim 1, wherein said means for angular adjusting further comprises means for angularly adjusting each of said external shoes.

11. The apparatus of claim 1, wherein each said external shoe includes a handle to facilitate movement thereof.

12. The apparatus of claim 1, wherein each said side edge of each said internal shoe and each said external shoe and each end edge of each said internal shoe are configured to minimize contact between said flexible material and portions of each said internal shoe and each said external shoe other than respective said side edges and end edges thereof.

13. The apparatus of claim 8, wherein each said side insert of each said internal shoe and each said end insert of each said internal shoe are configured to minimize contact between said flexible material and portions of each said internal shoe other than respective said side inserts and end inserts thereof.

14. The apparatus of claim 9, wherein each said side insert of each said external shoe is configured to minimize contact between said flexible material and portions of each said external shoe other than respective said side inserts thereof.

15. The apparatus of claim 13, wherein each said side insert of each said internal shoe includes a protrusion adjacent a said side edge, said protrusion minimizing contact between a bottom surface of each said internal shoe and said flexible material.

16. The apparatus of claim 14, wherein each said side insert of each said external shoe include a protrusion adjacent a said side edge, said protrusion minimizing contact between a bottom surface of each said external shoe and said flexible material.

17. The apparatus of claim 1, wherein each said internal is configured with its side edge in contact with said flexible material at an angle A with respect to horizontal and at an angle B with respect to said longitudinal axis of said adjustable tooling apparatus and each said external shoe is configured with its side edge in contact with said flexible material at an angle C with respect to said longitudinal axis of said adjustable tooling apparatus, said angle A defining a said second turning edge, each said angle B defining a respective first turning edge, and each said angle C defining a respective said third turning edge, wherein the relationship between each said angle A, angle B, and angle C is defined as:

$$1 = \mathrm{Cos}A - 2(\mathrm{Tan}B \cdot \mathrm{Tan}C).$$

18. The apparatus of claim 1, wherein said flexible material comprises a plastic film.

* * * * *